US005503570A

United States Patent [19]

Okada

[11] Patent Number: 5,503,570

[45] Date of Patent: Apr. 2, 1996

[54] FEMALE TERMINAL METAL FIXTURE FOR CONNECTOR

[75] Inventor: Hajime Okada, Yokkaichi, Japan

[73] Assignee: Sumitomo Wiring Systems, Ltd., Japan

[21] Appl. No.: 324,918

[22] Filed: Oct. 18, 1994

[30] Foreign Application Priority Data

Nov. 8, 1993 [JP] Japan ..... 5-064759 U

[51] Int. Cl.[6] ..... H01R 3/00

[52] U.S. Cl. ..... 439/488; 439/910

[58] Field of Search ..... 439/488, 849, 439/850, 852, 910, 912

[56] References Cited

U.S. PATENT DOCUMENTS

| | | | |
|---|---|---|---|
| 4,053,705 | 10/1977 | Schmidt | 439/488 X |
| 4,136,923 | 1/1979 | Spaulding . | |
| 4,152,042 | 5/1979 | Ostapovitch | 439/852 |
| 4,834,681 | 5/1989 | Chaillot | 439/852 X |
| 4,838,816 | 6/1989 | Matsusaka et al. | 439/852 X |
| 5,083,936 | 1/1992 | Yang | 439/852 X |
| 5,112,254 | 5/1992 | Endo | 439/852 |
| 5,271,740 | 12/1993 | Endo et al. | 439/852 X |
| 5,281,175 | 1/1994 | Chupak et al. | 439/852 X |

FOREIGN PATENT DOCUMENTS

| | | |
|---|---|---|
| 42332 | 12/1981 | European Pat. Off. . |
| 121637 | 10/1984 | European Pat. Off. . |
| 372736 | 6/1990 | European Pat. Off. . |
| 509859 | 10/1992 | European Pat. Off. . |
| 87476 | 6/1986 | Japan . |

*Primary Examiner*—Khiem Nguyen

*Attorney, Agent, or Firm*—Jordan B. Bierman; Bierman and Muserlian

[57] ABSTRACT

This invention aims to provide a female terminal metal fixture for a connector, in which a contacting pressure on an elastic contact piece can be precisely and easily measured. In the fixture, a box like fitting portion 2 is provided in its interior with an elastic contact piece 5. The piece 5 has a contact area 6 adapted to elastically contact with a male terminal metal fixture. The contact area 6 electrically contacts with the male fixture when it is inserted into the fitting portion 2. The portion 2 is provided with an inspection aperture 8 in its upper wall 7 above the contact area 6. Measurement of a contacting force on the elastic contact piece 6 and observation of a surface condition of the piece can be effected through the inspection aperture 8.

4 Claims, 2 Drawing Sheets

FEMALE TERMINAL METAL FIXTURE FOR CONNECTOR

BACKGROUND OF THE INVENTION

1. Field of the Invention

This invention relates to a female terminal metal fixture for a connector, which has a box like fitting portion with an open end and is adapted to receive a male terminal metal fixture for a mating connector in the fitting portion.

2. Statement of the Prior Art

For convenience of explanation, a conventional female terminal metal fixture for a connector will be described below by referring to FIG. 3. FIG. 3 is a perspective view of the conventional female terminal metal fixture for a connector.

A female terminal metal fixture 30 in a connecting construction of a connector is produced by punching a metal sheet into a given shape and bending it to a given form. The fixture 30 is provided on its front end with a box like fitting portion 31 having an end opening 34 and on its rear end with a barrel portion 32. An end of an electrical wire not shown is fixed to the barrel portion 32 by means of crimping.

The fitting portion 31 is provided in its interior with an elastic contact piece 33 which is formed by bending inwardly an end of a bottom wall of the portion 31 through the end opening, as shown in FIG. 3. The elastic contact piece 33 is bent slightly upwardly at its middle portion to form a contact area 36. Elasticity is imparted to the elastic contact piece 33 by forming a turned-back portion 35 and the bent contact area 36.

In order to couple a male mating terminal metal fixture not shown to the female terminal metal fixture 30, an elongate projecting tab of the male terminal metal fixture is inserted into the box like fitting portion 31 of the fixture 30. At this time, the tab is clamped between the contact area 36 on the elastic contact piece 33 and an upper wall of the fitting portion by an elastic force exerted in the piece 33, so that the male and female terminal metal fixtures are positively brought into electrical contact with each other.

If the elastic force (contact force) of the elastic contact piece 33 is small, the piece 33 cannot clamp the male terminal metal fixture sufficiently. This results in a contact failure between the male and female terminals. Accordingly, heretofore, inspection of products regarding the contact force of the elastic contact piece has been carried out.

In order to directly measure such contact force, an experiment has been effected by opening a wall of the box like fitting portion 31 to expose the elastic contact piece 33 and then pushing a measuring tool onto the piece 33 to deflect it. However, the measured female terminal metal fixture 30 itself cannot be used as goods. Thus, a measuring tool having a pushing tab which is similar to the tab of the male terminal metal fixture is inserted through the end opening 34 into the fitting portion 31. At this time, the contact force is assumed from a resistance of insertion of the tool.

In a connector to be used in, for example, an electrical circuit for actuating an air bag for a motorcar, an extremely high reliability is required. Thus, the contact area 36 is overlaid with gold to enhance its contact ability. It is required in this kind of female terminal metal fixture to carry out an extremely high quality control such as recording of a history of plating conditions on the contact area 36. One of the methods for observing the plating condition comprises the steps of sampling female terminal metal fixtures in a lot at random, opening an upper wall of the box like fitting portion 31 to expose the contact area 36, and radiating an X-ray on the contact area 36.

There are following problems upon measuring the contact force by the above method. The contact force is not always indicated to be an accurate value by the conventional method which assumes the contact force in accordance with the resistance force of insertion.

Also, in the conventional method of observing the surface condition of the elastic contact piece, the female terminal metal fixture which has been subject to observation cannot be used because the box like fitting portion 31 is opened to expose the elastic contact piece 33.

SUMMARY OF THE INVENTION

An object of the present invention is to provide a female terminal metal fixture in which a contact force of an elastic contact piece and a surface condition of the piece can be easily and precisely measured and observed.

In order to achieve the above object, a female terminal metal fixture for a connector in accordance with the present invention includes: a box like fitting portion which has an open end and is adapted to receive a male terminal metal fixture for a mating connector; an elastic contact piece which is formed by turning back an extending wall of the fitting portion into the interior of the fitting portion so that a contact area on the elastic contact piece elastically contacts with the male terminal metal fixture when it is inserted into the fitting portion; and a barrel portion adapted to hold an end of an electrical wire by means of crimping.

The fitting portion is provided with an inspection aperture in its upper wall above the elastic contact piece.

When the contact force of the elastic contact piece is directly measured, a measuring tool is inserted through the inspection aperture into the box like fitting portion to contact with the contact area at its distal end and pushing down the elastic contact piece.

When the surface condition of the contact area is observed, a person can directly observe it through the inspection aperture. That is, it is possible to observe the condition on the contact area by means of, for example, X-ray radiation.

According to the present invention, measurement of contact force of the elastic contact piece requires neither complicated work nor much time and further can obtain an accurate value because the measurement can be carried out directly through the inspection aperture without opening the box like fitting portion.

In addition, direct measurement can be effected without deforming the female terminal metal fixture, all of the fixtures can be measured, and quality control of products can be surely enhanced.

DETAILED DESCRIPTION OF THE PREFERRED EMBODIMENTS

Figure 1:
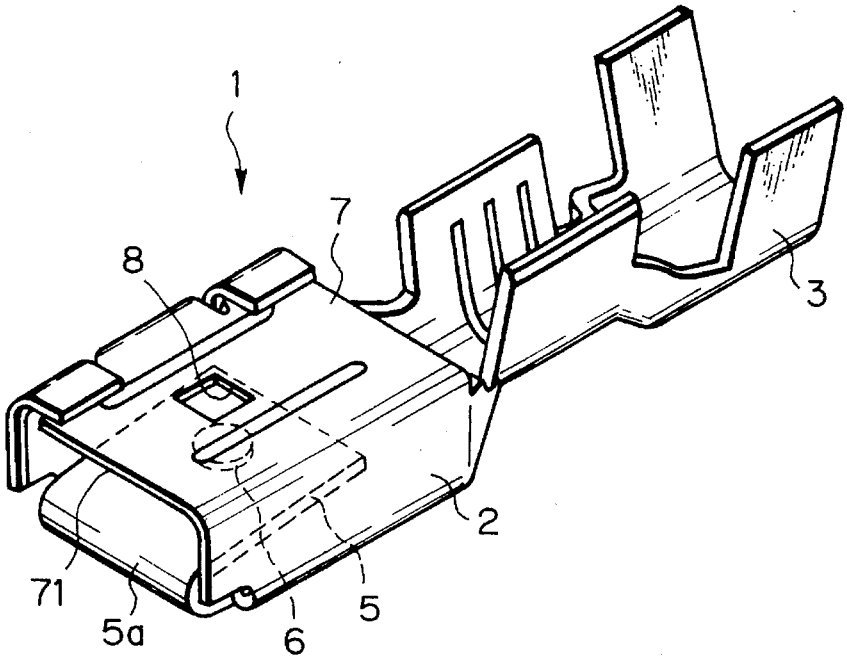
FIG. 1 is a perspective view of an embodiment of a female terminal metal fixture for a connector in accordance with the present invention.
Figure 2:
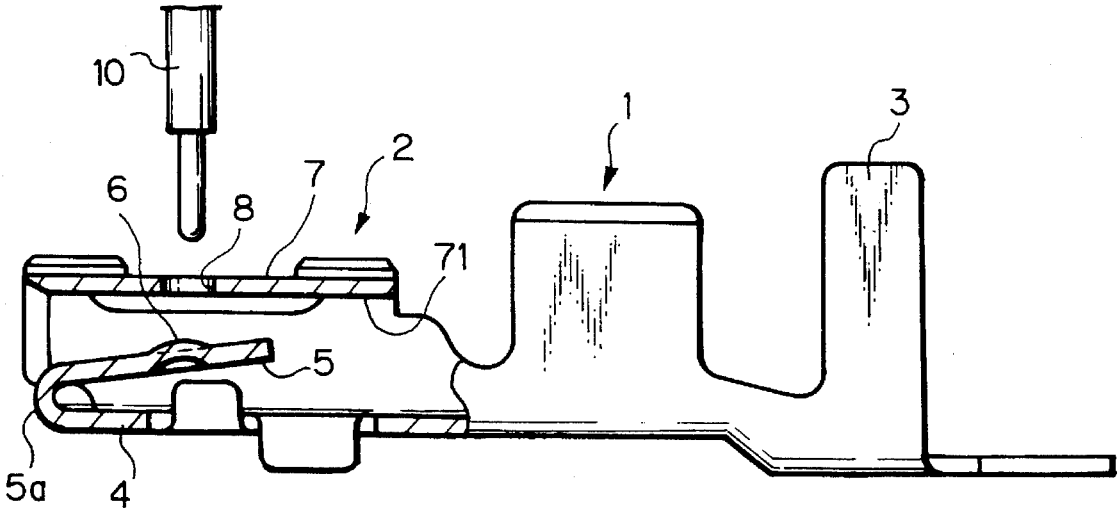
FIG. 2 is a partially broken side elevational view of the female terminal metal fixture shown in FIG. 1.
Figure 3:
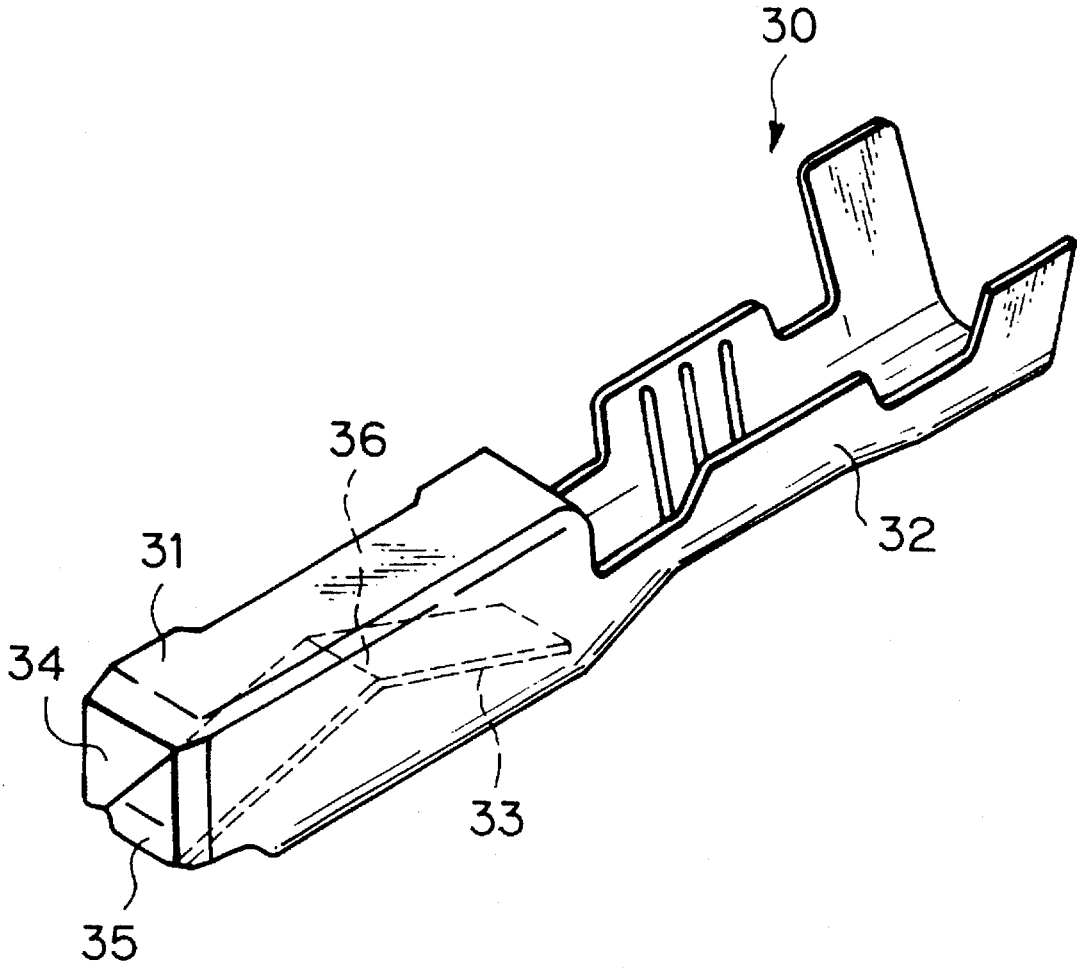
Fig. 3 PRIOR ART
FIG. 3 is a perspective view of a conventional female terminal metal fixture for a connector.

Referring now to FIGS. 1 and 2, an embodiment of a female terminal metal fixture for a connector in accordance with the present invention will be explained below.

A female terminal metal fixture 1 in this embodiment is provided in a connector to be used in a circuit for actuating an air bag for motorcars. When a mating male terminal metal fixture not shown is coupled to the female terminal metal fixture, electrical wires are electrically interconnected.

The female terminal metal fixture 1 is provided on its front side with a box like fitting portion 2 having an open end and its rear side with a barrel portion 3 adapted to clamp an end of an electrical wire not shown by means of crimping. The fitting portion 2 is made by punching a metal sheet into a given shape and bending it into a given form.

The box like fitting portion 2 is provided in its interior with an elastic contact piece 5 which is formed by turning back an extending wall from a bottom wall 4 into the portion 2. A turned-back portion 5*a* gives an elasticity to the elastic contact piece 5. The elastic contact piece 5 extends to a middle space in the interior of the fitting portion 2. The piece 5 is provided on its intermediate part with a contact area 6 bulging slightly outwardly. The contact area is overlaid with gold.

An elongate tab projecting from the mating male terminal metal fixture not shown is inserted into the box like fitting portion 2 of the female terminal metal fixture 1 so that they are interconnected. At this time, the male and female terminal metal fixtures are electrically interconnected, since the tab of the mating fixture is clamped between the contact area 6 on the elastic contact piece 5 and an inner face 71 on an upper wall 7 of the fitting portion 2 by means of an elastic force exerted in the piece 5.

The box like fitting portion 2 is provided with an inspection aperture 8 which serves to measure a contact load on the contact piece 5 and observe a surface condition on the piece. The inspection aperture 8 is formed into a square shape by removing a part of the upper wall 71 of the portion 7. The inspection aperture 8 is disposed right above the contact area 6 of the elastic contact piece 5.

Next, an operation of the above embodiment will be described below.

As shown in FIG. 2, a pressure force (contact force) of the elastic piece 5 is measured by the steps of inserting a measuring tool 10 through the inspection aperture 8 into the interior of the box like fitting portion 2, pushing the distal end of the tool onto the contact area 6, and deflecting the contact piece 5 by the same distance as that of the fitting state.

In the case where a gold plating on the surface of the contact area 6 must be recorded as a history, a radiation part of an X-ray radiation device opposes the inspection aperture 8 in the fitting portion 2 to radiate the X-ray onto the contact area 6 on the elastic contact piece 5. It is possible to observe the surface state of the elastic contact piece 5 in accordance with the results of X-ray radiation.

As described above, since the pressure force of the elastic contact piece 5 is directly measured in the female terminal metal fixture of this invention, the measured value indicates the accurate contact force. Accordingly, it is possible to positively detect a defective terminal which may cause a contact failure. Moreover, since the contact force can be measured without the necessity of opening the box like fitting portion, this measurement can easily be carried out on the female terminal. Furthermore, since such measurements are non destructive, those pieces which have been tested and found satisfactory can be used in the usual manner. Thus, it is possible to test all terminals being produced and easily separate the defective products from those which meet the required standards.

Also, the surface state of the elastic contact piece 5 can be directly observed without opening the fitting portion 2 by observing means. This observation requires neither complicated work nor much time. Accurate results of observation can be obtained.

Although the female terminal metal fixture is used in the circuit for the air bag in the above embodiment, the contact area may not be always overlaid with gold. The present invention is not limited to the above embodiment. The present invention may be changed to various kinds of alternations without departing from the spirit of the invention.

What is claimed is:

1. A female terminal for a connector including a box like fitting portion having an open end, said female terminal adapted to receive a male terminal of a mating connector, an elastic contact piece in said fitting portion, a contact area on said elastic contact piece and adapted to resiliently contact said male terminal when said male terminal is inserted into said fitting portion, and a barrel portion adapted to hold an end of an electrical wire, said fitting portion being provided with an inspection aperture in its upper wall above said contact area, whereby, said contact area is readily accessible through the inspection aperture.

2. The female terminal of claim 1 wherein said inspection aperture is formed into a square shape.

3. The female terminal of claim 1 wherein said contact area on said elastic contact piece is formed by means of bulging.

4. The female terminal of claim 1 wherein said contact area is overlaid with gold.

* * * * *